United States Patent [19]

Grecco

[11] Patent Number: 4,991,417

[45] Date of Patent: Feb. 12, 1991

[54] KEY EXTENSION FOR THE PHYSICALLY IMPAIRED

[76] Inventor: Pasquale Grecco, 37 16th St., Hicksville, N.Y. 11801

[21] Appl. No.: 496,369

[22] Filed: Mar. 20, 1990

[51] Int. Cl.[5] ..... E05B 19/00

[52] U.S. Cl. ..... 70/408; 294/1.1

[58] Field of Search ..... 294/1.1; 70/456 R, 457, 70/458, 408, 395; 206/37.1-37.8; 16/110 R, 114 R; 81/121.1, 125

[56] References Cited

U.S. PATENT DOCUMENTS 1,852,950 4/1932 Amrhein ..... 70/456 R X
3,209,479 10/1965 Manzardo ..... 206/37.1 X
4,583,383 4/1986 Bosco et al. ..... 70/458 X
4,910,983 3/1990 Taylor ..... 70/408 X

*Primary Examiner*—Johnny D. Cherry
*Assistant Examiner*—Dean J. Kramer
*Attorney, Agent, or Firm*—Michael I. Kroll

[57] ABSTRACT

A key extension for the physically impaired is provided and consists of a shank portion with an enlarged handle portion affixed to one end and a head portion affixed to a second end of the shank portion. The head portion retains a bow of a standard key therein so that a blade of the standard key can be inserted within a lock allowing the physically impaired to turn the key extension to operate the lock.

2 Claims, 1 Drawing Sheet

KEY EXTENSION FOR THE PHYSICALLY IMPAIRED

BACKGROUND OF THE INVENTION

1. Field of the Invention

The instant invention relates generally to key holders and more specifically it relates to a key extension for the physically impaired.

2. Description of the Prior Art

Numerous key holders have been provided in prior art that are adapted to engage with keys so that the keys will not get lost. While these units may be suitable for the particular purpose to which they address, they would not be as suitable for the purposes of the present invention as heretofore described.

SUMMARY OF THE INVENTION

A primary object of the present invention is to provide a key extension for the physically impaired that will overcome the shortcomings of the prior art devices.

Another object is to provide a key extension for the Physically impaired which allows a person with limited grip and movement to hold and turn a key in a lock.

An additional object is to provide a key extension for the physically inpaired in which a person's own standard key will fit into the device so that the device will become an extension of the key.

A further object is to provide a key extension for the physically impaired that is simple and easy to use.

A still further object is to provide a key extension for the physically impaired that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

DETAILED DESCRIPTION OF THE PREFERRED EMBODIMENTS

Figure 1:
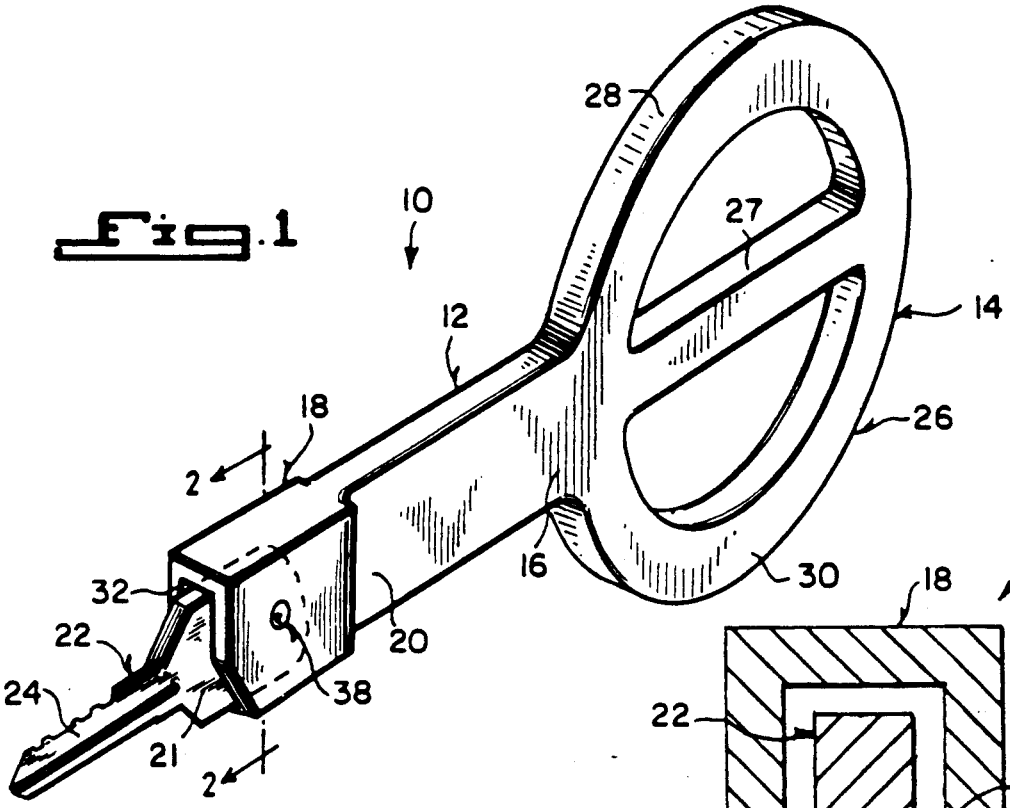
FIG. 1 is a perspective view of the invention.

Turning now descriptively to the drawings, in which similar reference characters denote similar elements throughout the several views, FIG. 1 illustrates a key extension 10 for the physically inpaired consisting of a shank portion 12 with an enlarged handle portion 14 affixed to a first end 16 of the shank portion 12. A head portion 18 is affixed to a second end 20 of the shank portion 12. The head portion 18 retains a bow 21 of a standard key 22 therein so that a blade 24 of the standard key 22 can be inserted within a lock (not shown) allowing the physically impaired to turn the key extension 10 to operate the lock.

The shank portion 12 is flexible and rectangular in its cross sectional configuration, while the enlarged handle portion 14 is an annular ring 26 having a bar 27 extending across its diameter in alignment with the shank portion 12 to divide the annular ring 26 into a first segment 28 and a second segment 30. The physically impaired can contact the shank portion 12, push/pull the first segment 28 of the annular ring 26 of the handle portion 14 and push/pull the second segment 30 of annular ring 26 of the handle portion 14 with a hand, elbow, wrist, palm and other parts of the body to turn the key extension 10 to operate the lock.

Figure 2:
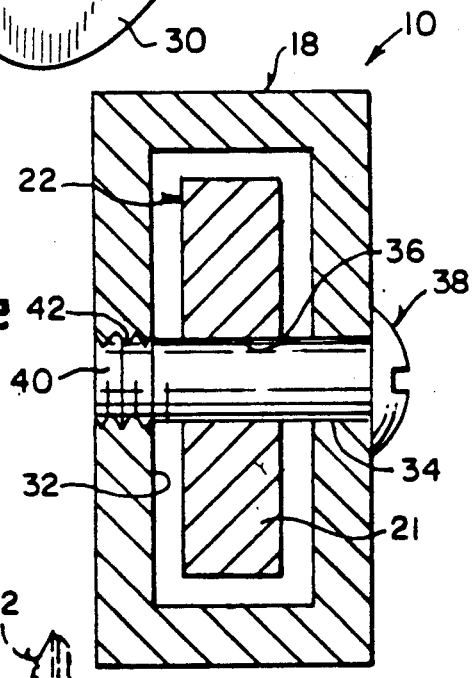
FIG. 2 is a cross sectional view taken alone line 2—2 in FIG. 1, showing the bolt in the head portion in greater detail.

As shown in FIGS. 1 and 2, the head portion 18 has a recess 32 extending therein opposite from the affixed second end 20 of the shank portion 12 and has a transverse aperture 34 extending through the recess 32. The bow 21 of the standard key 22 can be received in the recess 32 with the hole 36 in the bow 21 in alignment with the transverse aperture 34. A bolt 38 having a threaded shaft 40 enters through the transverse aperture 34 in the hole 36 in the bow 21 to threadably engage with the head portion 18 at holes 42 so as to retain the standard key 22 thereto.

Figure 3:
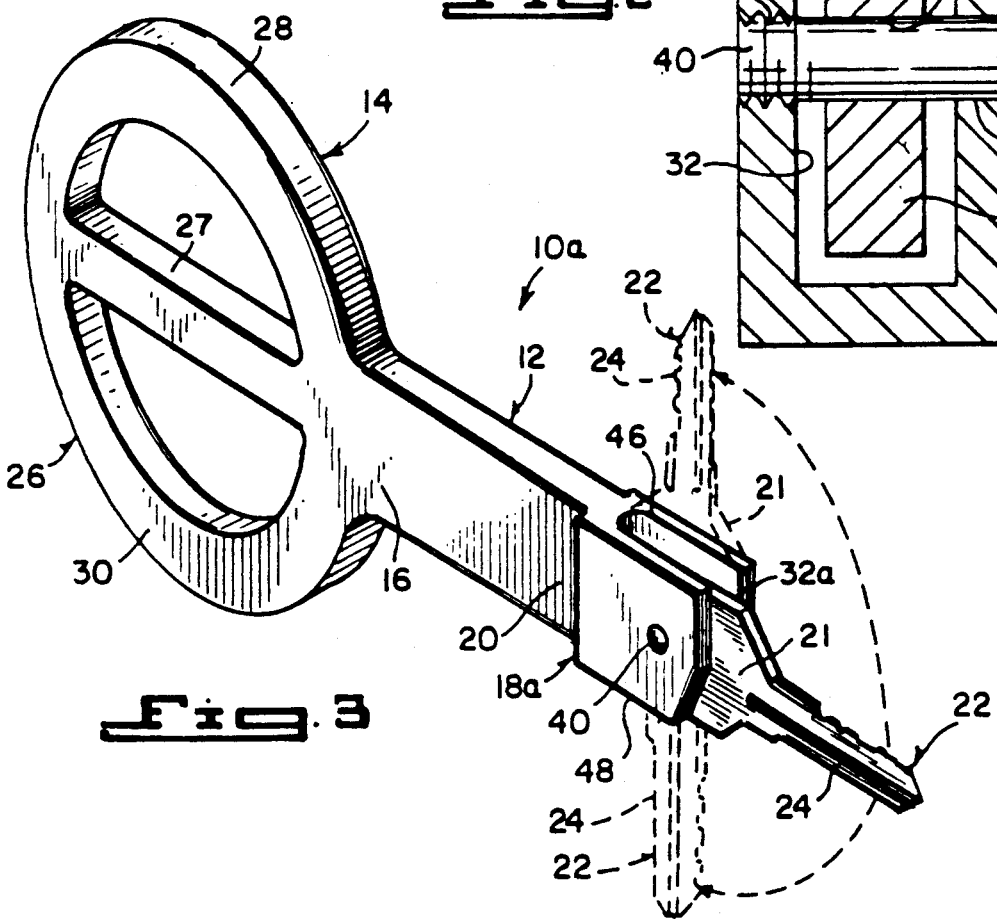
FIG. 3 is a perspective view of a modification in which the key can swing between a 180 degree arc in the head portion.

FIG. 3 shows a modified key extension 10*a* in which the recess 32*a* in the head portion 18*a* has a pair of open ends 46 and 48 so that the head portion 18*a* becomes a forked shaped configuration thus allowing the standard key 22 to swing between an 180 degree arc to help aid the physically impaired to operate the lock.

LIST OF REFERENCE NUMBERS 10 key extension
10*a* modified key extension
12 shank portion
14 enlarged handle portion
16 first end of 12
18 head portion in 10
18*a* head portion in 10*a*
20 second end of 12
21 bow
22 standard key
24 blade of 22
26 annular ring
27 bar
28 first segment of 26
30 second segment of 26
32 recess in 18
32*a* recess in 18*a*
34 transverse aperture in 18
36 hole in 21
38 bolt
40 threaded shaft on 38
42 threaded hole
46 open end in 18*a*
48 open end in 18*a*

It will be understood that each of the elements described above, or two or more together, may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth inthe appended claims:

1. A key extension for the physically impaired comprising:

(a) a shank portion;

(b) an enlarged handle portion affixed to a first end of said shank portion;

(c) a head portion affixed to a second end of said shank portion; and (d) means in said head portion, for retaining a bow of a standard key therein so that a blade of the standard key can be inserted within a lock allowing the physically impaired to turn said key extension to operate the lock;

wherein said shank portion is flexible and rectangular in its cross sectional configuration;

wherein said enlarged handle portion is an annular ring having a bar extending across its diameter in alignment with said shank portion to divide said annular ring into a first segment and a second segment so that the physically impaired can contact said shank portion, push/pull said first segment of said annular ring of said handle portion and push/pull said second segment of said annular ring of said handle portion with a hand, elbow, wrist, palm and other parts of the body to turn said key extension to operate the lock;

wherein said retaining means includes:

(a) said head portion having a recess extending therein opposite from the affixed second end of said shank portion and having a transverse aperture extending through said recess so that the bow of the standard key can be received in said recess with the hole in the bow in alignment with said transverse aperture; and (b) a bolt having a threaded shaft to enter through said transverse aperture and the hole in the bow to threadably engage with said head portion so as to retain the standard key thereto.

2. A key extension as recited in claim 1, further including said recess in said head portion having a pair of open ends so that said head portion becomes a forked shaped configuration thus allowing the standard key to swing between a 180 degree arc to help aid the physically impaired to operate the lock.

* * * * *